United States Patent [19]

McClure

[11] Patent Number: 4,463,791

[45] Date of Patent: Aug. 7, 1984

[54] VENETIAN BLIND CORD LOCK FOR UP TO EIGHT LIFT CORDS

[75] Inventor: David K. McClure, Muncy, Pa.

[73] Assignee: Marathon Manufacturing Company, Houston, Tex.

[21] Appl. No.: 502,736

[22] Filed: Jun. 10, 1983

Related U.S. Application Data

[63] Continuation-in-part of Ser. No. 460,445, Jan. 24, 1983.

[51] Int. Cl.[3] ..... E06B 9/38

[52] U.S. Cl. ..... 160/178 C

[58] Field of Search ..... 160/166, 168, 172, 173, 160/174, 176, 178 R, 178 C, 84 R

[56] References Cited

U.S. PATENT DOCUMENTS

| | | | |
|---|---|---|---|
| 1,663,819 | 3/1928 | Shaft | 160/84 R |
| 2,194,277 | 3/1940 | Feeney | 160/173 |
| 2,391,709 | 12/1945 | Kasan | 160/174 |
| 2,562,781 | 7/1951 | Fox | 160/174 |
| 2,744,572 | 5/1956 | Lorentzen | 160/173 |
| 3,799,236 | 3/1974 | Debs | 160/178 C |
| 3,931,846 | 1/1976 | Zilver | 160/178 C |
| 3,952,789 | 4/1976 | Marotto | 160/178 C |
| 4,180,118 | 12/1979 | Vecchiarelli | 160/178 C |
| 4,245,688 | 1/1981 | Vecchiarelli | 160/178 C |
| 4,250,597 | 2/1981 | Ford et al. | 160/178 C |
| 4,327,797 | 5/1982 | Nakajima et al. | 160/178 C |

*Primary Examiner*—Peter M. Caun

*Attorney, Agent, or Firm*—Robert K. Youtie

[57] ABSTRACT

A cord lock for up to eight lift cords including an open-work, grid-like structure adapted to seat on the bottom wall of a headrail channel over a bottom wall opening; the grid-like structure including intersecting longitudinal and transverse members; upwardly facing formations for retaining engagement beneath inturned lips of the channel; a depending formation for restraining engagement through the channel bottom wall opening; generally vertically extending way means formed in the longitudinal members, and a transversely extending jamming element freely shiftable up and down in the way means into and out of cord jamming relation with an adjacent cross member.

11 Claims, 5 Drawing Figures

FIG. 1
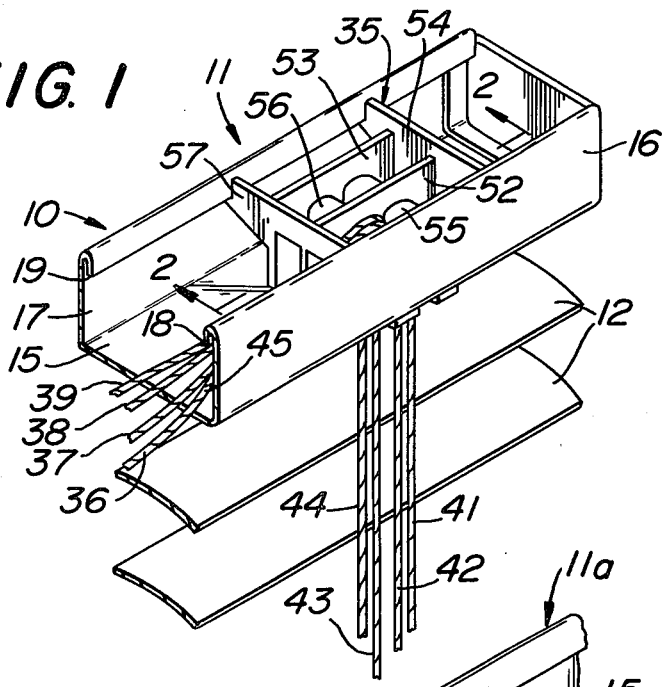
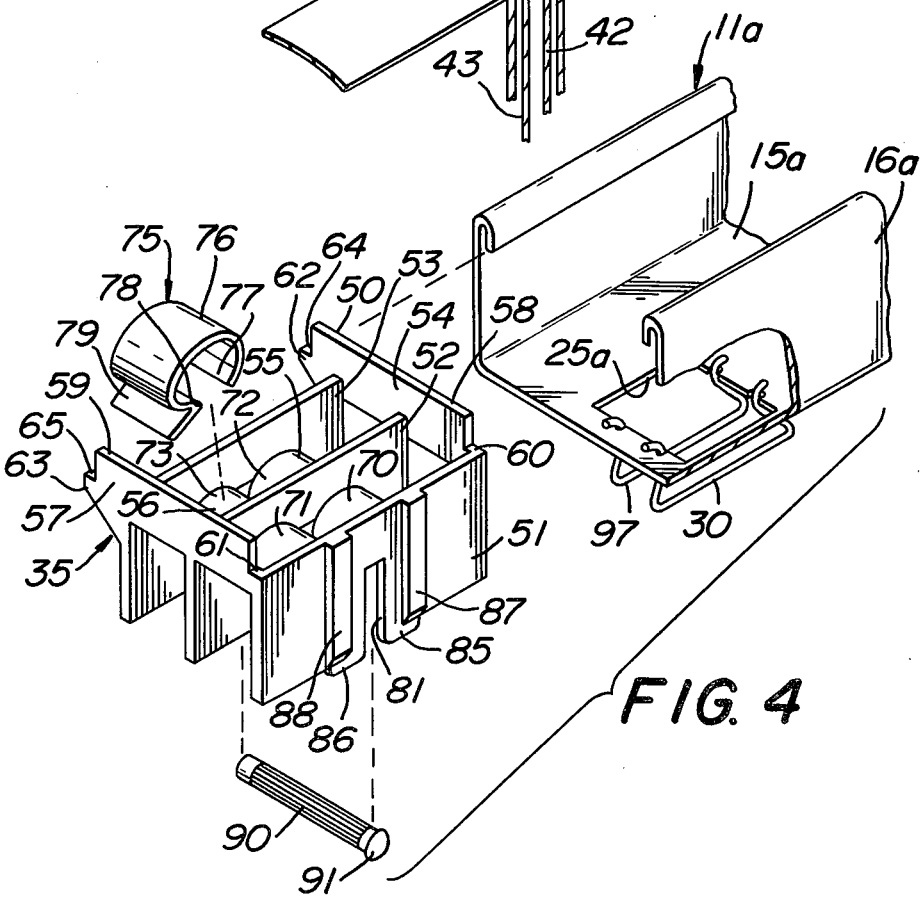
FIG. 4

FIG. 2
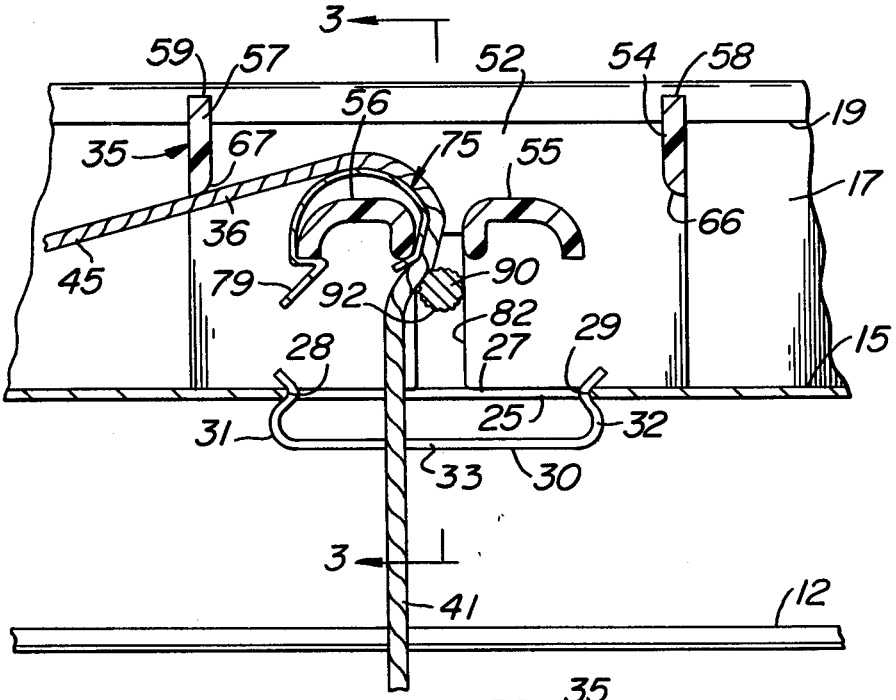
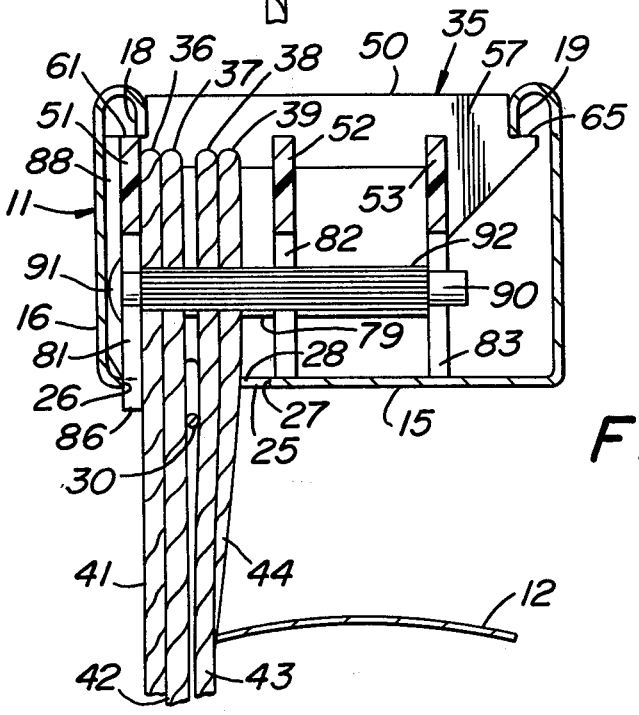
FIG. 3

VENETIAN BLIND CORD LOCK FOR UP TO EIGHT LIFT CORDS

CROSS-REFERENCES TO RELATED APPLICATIONS

This application is a continuation-in-part of patent application Ser. No. 6-460,445, filed Jan. 24, 1983.

BACKGROUND OF THE INVENTION

As noted in said co-pending application, prior venetian blind lift cord locks have been relatively complex and expensive, being assembled of a plurality of separately formed metal parts, and requiring expensive mounting in a headrail channel, as by rivets, or the like.

Applicant is aware of the below listed prior art concerning venetian blind cord locks:

| U.S. PAT. NO. | PATENTEE |
|---|---|
| 2,194,277 | Feeney |
| 2,391,709 | Kasan |
| 2,562,781 | Fox |
| 3,931,846 | Zilver |
| 3,952,789 | Marotto |
| 4,180,118 | Vecchiarelli |
| 4,250,597 | Ford et al. |
| 4,327,797 | Nakajima et al. |

SUMMARY OF THE INVENTION

It is an important object of the present invention to provide a greatly simplified cord lock construction which may be economically mass produced essentially of a single plastic part; which is adapted for instantaneous snap assembly with a headrail without additional fastening elements or operations; which is durable in construction and reliable in operation throughout a long useful life; and which is extremely versatile for use with venetian blinds requiring from four to eight lift cords.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a partial, top perspective view showing a venetian blind construction including a cord lock of the present invention.

FIG. 2 is a partial longitudinal sectional view taken generally along the line 2—2 of FIG. 1.

FIG. 3 is a transverse, sectional elevational view taken generally along the line 3—3 of FIG. 2.

FIG. 4 is an exploded perspective view showing the cord lock of the present invention and a headrail channel, the latter being formed for six or eight cord lock usage.

DESCRIPTION OF THE PREFERRED EMBODIMENTS

Figure 5:
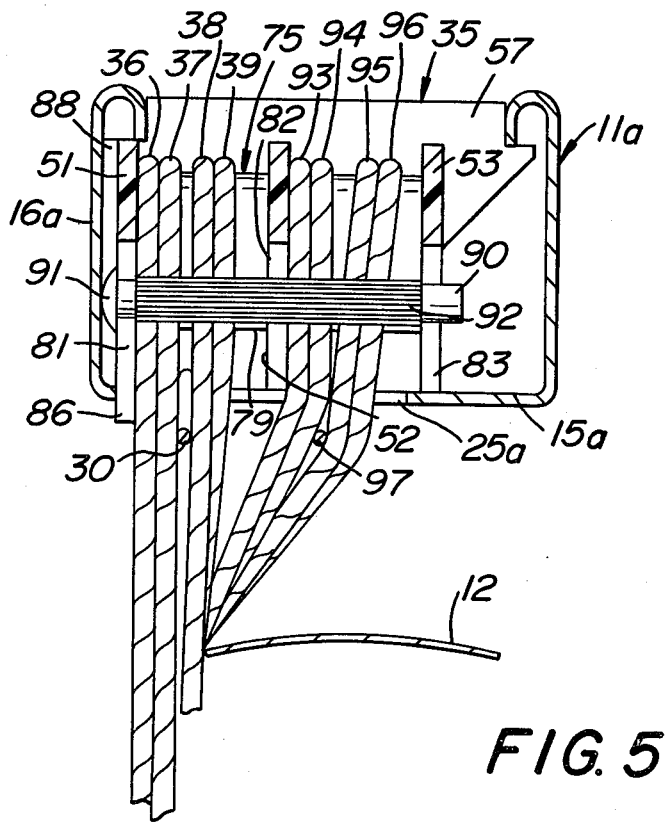
FIG. 5 is a transverse sectional elevational view similar to FIG. 3, but showing additional lift cords in a cord lock of the present invention assembled with the headrail channel in FIG. 4.

Referring now more particularly to the drawings, and specifically to FIG. 1 thereof, a venetian blind is there generally designated 10 and includes at its upper end a normally horizontally disposed headrail 11, and below the headrail are a plurality of horizontally extending, superposed slats 12. The headrail may be conventional, being defined by a channel including a generally a generally horizontal bottom wall 15, and upstanding from front and rear longitudinal edges of the bottom wall are front and back walls 16 and 17. The channel or headrail 11 may be of generally rectangular cross section, as illustrated, with the bottom wall 15 generally horizontal and the front and back walls 16 and 17 upstanding vertically and in parallelism with each other, spaced apart by the width or depth of the bottom wall. The upper longitudinal margins or edges of the front and back channel walls 16 and 17 may be curled, bent or turned inwardly and downwardly, as at 18 and 19 to define retaining lips, as will appear more fully hereinafter.

The bottom wall 15 of headrail channel 11 may be formed with a through opening, hole or cut-out, as at 25, which may be generally rectangular or other suitable configuration, and is best seen in the longitudinal and transverse views of FIGS. 2 and 3. More specifically, the generally rectangular cut-out 25 of channel bottom wall 15 is bounded within generally parallel longitudinally extending front and rear side edges 26 and 27, and forwardly and rearwardly extending end edges 28 and 29. Laterally medially the end edges 28 and 29 may be notched to releasably receive opposite end regions of a generally U-shaped spring clip 30. The spring clip 30 may include an elongate, medial portion 33 extending longitudinally of the bottom wall opening 25, and upwardly extending opposite end portions or legs 31 and 32 respectively snapped into retaining engagement with end edges 28 and 29 of bottom wall opening 25.

Interiorly of the channel 11, over the opening or hole 25, there is mounted a cord lock assembly, generally designated 35. Extending through the cord lock assembly 35, in FIGS. 1–3, are a plurality of lift cords, being four in number, and respectively designated from front to rear as 36, 37, 38 and 39. Thus, the embodiment of FIGS. 1–3 illustrates the cord lock of the present invention as employed with four lift cords, say in a venetian blind of sufficient width to require such number of lift cords. The cord lock 35 of FIGS. 1–3 may be identical to the cord lock 35 of FIGS. 4 and 5, the latter figures differing only in illustration of usage with more than four lift cords, as will appear presently.

The several lift cords 36, 37, 38 and 39 each including a manual actuating portion, as at 41, 42, 43 and 44, respectively, all depending through the cut-out 25 forwardly of the slats 12. From within the cord lock 35, the several lift cords extend generally horizontally out of the cord lock along the interior of the channel 11, as the lift cord portion 45 of forwardmost lift cord 36. It will be observed in FIG. 3 that the clip 30 may serve to separate the forward lift cords 41 and 42 from the rearward lift cords 43 and 44.

The cord lock 35 is best seen in FIG. 4 as an openwork, hollow or grid-like structure 50. The structure 50 is of generally rectangular overall configuration, well adapted for economic mass production by injection molding, and includes a plurality of at least three, spaced apart longitudinal members 51, 52 and 53, being respectively forwardmost, intermediate and rearwardmost when assembled in the channel 11. The longitudinal members 51, 52 and 53 may be horizontally extending, upstanding vertical plates or walls, substantially longitudinally coextensive and having their lower and upper edges substantially coplanar with the lower edges resting on the channel bottom wall 15.

Extending transversely of and secured to the longitudinal members 51–53 to define the grid-like structure 50 are a plurality of at least four, spaced cross members 54, 55, 56 and 57. The transverse members 54 and 57 are generally vertical plates or end walls extending between adjacent ends of the longitudinal members or plates 51–53. More specifically, the end plates or walls 54 and 57 are spaced considerably above the lower edges of the longitudinal walls 51–53, being integrally joined to the adjacent ends thereof, and have their upper edges 58 and 59 disposed generally horizontally in the forward and rearward direction and spaced above the upper edges of the longitudinal walls 51–53. The upper regions of the end walls 54 and 57 terminate short of the forwardmost longitudinal wall 51, to define forwardly and upwardly facing notch formations 60 and 61, respectively. The rearward regions of the end walls 54 and 57 extend rearwardly beyond the rearmost longitudinal wall 53, as at 62 and 63; and are formed at their rearward extremities with rearwardly and upwardly facing notch formation 64 and 65, respectively. Thus, the longitudinal walls 51–53 may be considered as offset forwardly of the mid-region of the forwardly and rearwardly extending end walls 54 and 57. Further, as seen in FIG. 2, the lower edges of the end walls 54 and 57 are advantageously rounded on their inner sides, as at 66 nd 67, respectively.

The inner or intermediate transverse members 55 and 56 include forward portions 70 and 71, and rearward portions 72 and 73. The forward portions 70 and 71 of intermediate transverse members 55 and 56 extend between the forward longitudinal member 51 and the intermediate longitudinal member 52, while the rearward portions 72 and 73 extend between the intermediate longitudinal member 52 and the rearward longitudinal member 53. The intermediate transverse members 55 and 56 serve as guides over which the lift cords may be trained, the transverse members or guides being of an inverted U-shaped configuration in cross section. As best seen in FIG. 2, the transverse members or guides 55 and 56 are spaced vertically between the lower and upper edges of the longitudinal walls 51–53. Further, to avoid wear of lift cords and those guides 55, 56 over which the lift cords are trained, selected guides or portions thereof may be provided with a wear member, guard or shield 75, which may be a separate piece fashioned of smooth, resiliently deflectable sheet metal, including an arcuate main portion 76 of generally semicircular extent and having at opposite ends generally radially inturned flanges or lips 77 and 78. Extending from the inner end of one lip 78 may a radially outstanding finger or extension 79. The collar or guard 75 is engaged in conformably covering relation with the inverted channel-shaped guide 56, being resiliently distended for snap engagement about the latter and thereby retained in this protective relationship. Should removal be desired, the finger 79 may be employed to reverse the above procedure and remove the collar 75.

The inner or intermediate transverse members 55 and 56 are adjacent to, but spaced from each other, as best seen in FIG. 2. Extending upwardly through the lower edges of the longitudinal walls 51, 52 and 53 are vertically disposed, aligned slots 81, 82 and 83. The slots 81, 82 and 83 are aligned forwardly and rearwardly and extend upwardly to terminate at closed upper ends between the intermediate transverse members or guides 55 and 56.

Additionally, the hollow structure 50 includes depending formations on the lower edges of forwardmost wall 51, as at 85 and 86. More specifically, the formations 85 and 86 are downwardly extending projections, lugs or extensions of the lower edge of wall 51, proximate to an on opposite sides of the slot 81, being spaced from opposite ends of the wall 51. The overall horizontal extent of the depending formations or lugs 85 and 86 is approximately equal to the longitudinal dimension of the cut-out 25, for conforming entry therein, as will appear presently.

On opposite sides of the slot 81 of the forwardmost wall 51, on the exterior or forward face thereof, there are formed a pair of protruding ribs, lands or spacers, as at 87 and 88. That is, the lands or spacers 87 and 88 extend generally vertically from the upper edge of the forwardmost wall 51, downwardly along the front surface of the latter wall, being spaced on opposite sides of the slot 81 and terminating proximate to the lower edge of the forward wall, spaced above the lower edges or extremities of the depending formations 85 and 86.

In assembly of the cord lock structure 50 in the headrail channel 11, the cord lock structure may be snapped downwardly into the headrail, or slid endwise through the headrail, in either case into proper location over the headrail opening 25. In this condition the upwardly facing formations or notches 61 and 60 conformably receive the forward inturned channel lip 18, while the upper formations 64 and 65 conformably receive the rear inturned channel lip 19. This effectively restrains the cork lock formation 50 against forward and rearward movement in the headrail. Also, the forward wall formations 87 and 88 may be engageable with the front wall 16 of the headrail channel to insure proper spacing of the cord lock front wall 15 from the channel front wall 51, as seen in FIG. 3.

In addition, the lower, depending formations 85 and 86 are engaged downwardly through the cut-out or opening 25 of the headrail bottom wall 15, and extend closely along the forward edge 26 of the cut-out 25, substantially throughout the entire length thereof.

This is best seen in FIGS. 1 and 3, wherein will appear that the depending protrusions 85 and 86 depend below the headrail bottom wall 15. Also, it will appear in FIG. 3 that the opening or cut-out 25 is spaced slightly rearwardly from the front headrail wall 16, so that the entire rectangular opening 25 is formed in the flat region of the channel bottom wall 15, rather than in the curved corner regions of the bottom wall. That is, in making the bends to form a channel, there is necessarily some curvature at the junctures of the channel walls. By locating the aperture 25 slightly spaced from the front channel wall 16, the opening is located entirely in the flat region of the bottom wall rather than in the curved wall juncture. This arrangement facilitates both fabrication and assembly.

Extending forwardly and rearwardly through the aligned slots 81, 82 and 83 is an elongate jamming member or pin, which is loosely received in the aligned slots for free up and down movement therein. On the forward end of the pin 90 is an enlargement or head 91 freely vertically movable in and captured within the space between the front cord lock wall 51 and the front channel wall 16, as between the spacers or lands 87 and 88. The pin is advantageously of a frictional surface formation, such as by knurling 92 or otherwise.

By the frictional engagement of jamming member or pin 90 with the lift cords 36–39, the pin will be elevated upon release of the cords to effectively jam the cords between the pin and the guide cover 75, the condition shown in FIG. 2. Upon downward pulling on the manually actuable cord portions 41–44, the jamming member 90 will be moved downwardly out of its jamming engagement and the blinds may be elevated. Upon release of the lift cords, the jamming element will effect cord locking, as noted herebefore; or, upon leftward movement of the manually actuable cord portions 41–44 (as seen in FIG. 2), the jamming element 90 will be released and the blinds may be lowered.

As best seen in FIG. 3, the depending formations 85 and 86, in addition to their locating function, serve to protect the cords from abrasion by the edge 26 of cut-out 25.

While the embodiment of FIGS. 1–3 shows the cord lock assembly 35 mounted in a headrail channel 11 adjacent to the right hand end thereof, commonly called right hand operation, it is apparent that the cord lock assembly may be mounted for left hand operation, if desired. Toward this end, the cord lock structure would be shifted to the left hand end of the headrail channel 11, and the lift cord portions 36, 37, 38 and 39 trained rightward over the right guide member 55, or a suitable shield, and thence beneath the smoothly curved lower edge 66 of head wall 54 to their respective lifting locations.

In FIG. 5 is shown the cord lock assembly 35 employed in conjunction with a relatively wide, heavy venetian blind requiring an additional four lift cords 93, 94, 95 and 96. This illustrates that the instant cord lock construction is capable of use with any selected number of lift cords, up to eight.

In order to accomodate eight lift cords, the channel **11*a* of FIGS. 4 and 5 is formed in its bottom wall 15*a* with a generally rectangular opening, hole or cut-out 25*a* which is of greater forward and rearward extent then first described bottom wall opening 25, so as to underly both the forward guide portions 70 and 71, as well as the rearward guide portions 72 and 73. The cut-out or hole 25*a* is similarly spaced slightly rearwardly from the front headrail wall 16*a* so as to lie entirely in the flat region of the headrail bottom wall 15*a***.

In addition to the first described spring clip 30 effectively separating and guiding the first described four lift cords 36–39, there is advantageously an additional spring clip 97 extending longitudinally of and across the rearward portion of the relatively large cut-out **25*a* for separating and guiding the additional lift cords 93–96. As best seen in FIG. 5, the forward pair of additional lift cords 93 and 94 may be located forwardly of the clip 97, and the rearward pair of additional lift cords 95 and 96 may be located rearwardly of the clip end 97. Also, the forwardly located lift cords 93 and 94 of the added lift cords may be effectively separated from the rearward lift cords 38 and 39 of the first described group by engagement of the lift cords 33 and 34 with the intermediate longitudinal wall 52. Of course, in its eight cord mode of operation, the cord lock assembly 35** may be mounted for left hand operation and well as right hand operation.

From the foregoing, it is seen that the present invention provides a venetian blind cord lock which is well adapted for use with blinds of varying widths, substantially greater than those normally stocked, so as to be of particular value in the field of custom blinds.

Although the present invention has been described in some detail by wal of illustration and example for purposes of clarity of understanding, it is understood that certain changes and modifications may be made within the spirit of the invention.

What is claimed is:

1. In a venetian blind, the combination comprising a headrail channel including a generally horizontal elongate bottom wall, generally longitudinally extending front and back walls upstanding from longitudinal edges of said bottom wall, and inturned upper lips on said front and back walls, said bottom wall having a cut-out adjacent to and spaced from said front wall for passing lift cords; and a cord lock in said channel comprising a plurality of at least three spaced longitudinal members, a plurality of at least four spaced cross members extending transversely of and secured to said longitudinal members to define a grid-like structure, said grid-like structure resting on said bottom wall and having upper formations engageable with said upper lips for limiting vertical and lateral movement of said structure in said channel, a depending formation on one of said longitudinal members engaging in said cut-out to limit longitudinal movement of said structure, generally vertically extending way means in said longitudinal members between the intermediate pair of said cross members, and a jamming element freely shiftable up and down in said way means toward and away from cord jamming relation with the cross members of said intermediate pair, whereby lift cords are adapted to be theaded over said intermediate pair of cross members on both sides of the inner of said longitudinal members and under the outer of said cross members, for location of said cord lock at either end or medially of said channel and accomodation by said cord lock of up to 8 cords.

2. The combination according to claim 1, said longitudinal members comprising vertical plates having their lower edges engaging with said bottom wall, said depending formation depending from the forwardmost of said vertical plates.

3. The combination according to claim 1, the outer cross members being spaced over said bottom wall to pass therebelow cords from over said intermediate cross members.

4. The combination according to claim 3, said outer cross members having said upper formations engaging with said upper lips.

5. The combination according to claim 2, said way means being defined by aligned vertical slots in said vertical plates, said jamming element comprising a pin extending through all of said slots and having a frictional surface.

6. The combination according to claim 5, the slot of said forwardmost plate including an aligned extension extending through said depending formation.

7. The combination according to claim 6, said grid-like structure being symmetrical about said way means, to facilitate installation and use at either end of said channel.

8. The combination according to claim 1, said upper formation comprising notches receiving said lips and maintaining the forwardmost longitudinal member spaced from said front wall for location of the forwardmost longitudinal member over a flat region of said bottom wall when the latter is connected to the front wall by a bend.

9. The combination according to claim 8, said depending formation having a medial opening defining an extension of said way means.

10. The combination according to claim 9, in combination with external ribs on said forwardmost longitudinal member to assure spacing of the latter from said front wall and prevent binding of said jamming element against said front wall.

11. The combination according to claim 8, said upper formations being located to space the rearwardmost longitudinal member further from said back channel wall than the forwardmost longitudinal member is spaced from the front channel wall, to offset said cord lock forwardly in said channel.

* * * * *